US006379207B1

(12) United States Patent
Castagner et al.

(10) Patent No.: US 6,379,207 B1
(45) Date of Patent: Apr. 30, 2002

(54) INFLATABLE LIFE BUOY LAUNCHER GUN

(75) Inventors: Bernard Castagner, Coupvray; Jean-Pierre Boyault, Lognes, both of (FR)

(73) Assignee: S.E.I.B. SARL, Reims (FR)

( * ) Notice: Subject to any disclaimer, the term of this patent is extended or adjusted under 35 U.S.C. 154(b) by 0 days.

(21) Appl. No.: 09/445,901

(22) PCT Filed: Jun. 12, 1998

(86) PCT No.: PCT/FR98/01234

§ 371 Date: Mar. 8, 2000

§ 102(e) Date: Mar. 8, 2000

(87) PCT Pub. No.: WO98/56653

PCT Pub. Date: Dec. 17, 1998

(30) Foreign Application Priority Data

Jun. 13, 1997 (FR) ..... 97 07456

(51) Int. Cl.[7] ..... B63C 9/22
(52) U.S. Cl. ..... 441/98; 441/85
(58) Field of Search ..... 441/84, 85, 98; 102/504; 89/1.816

(56) References Cited

U.S. PATENT DOCUMENTS

| | | | | | |
|---|---|---|---|---|---|
| 3,496,580 | A | * | 2/1970 | Gulmon et al. | 441/85 |
| 3,550,501 | A | * | 12/1970 | Munger et al. | 89/1.816 |
| 3,886,612 | A | | 6/1975 | Schnirel et al. | 9/14 |
| 3,956,843 | A | * | 5/1976 | Litman | |
| 4,094,028 | A | | 6/1978 | Fujiyama et al. | |
| 4,724,740 | A | * | 2/1988 | Garcia | 89/37.05 |
| 4,732,075 | A | | 3/1988 | Hurd | 89/44.02 |
| 4,799,906 | A | | 1/1989 | Perkins, Jr. | 441/85 |
| 5,584,736 | A | * | 12/1996 | Salvemini | 441/85 |

FOREIGN PATENT DOCUMENTS

| | | | | |
|---|---|---|---|---|
| BE | 808 798 | | 4/1974 | |
| DE | 43 04 231 | A1 | 8/1994 | |
| EP | 0 767 099 | A1 | 4/1997 | |
| FR | 2 148 889 | | 3/1973 | |
| GB | 903198 | | 6/1960 | |
| JP | 54-8391 | * | 1/1979 | 441/98 |

* cited by examiner

*Primary Examiner*—Sherman Basinger
(74) *Attorney, Agent, or Firm*—Townsend and Townsend and Crew LLP

(57) ABSTRACT

The invention concerns an inflatable life buoy launcher gun for throwing, towards a shipwrecked person, a life buoy or life jacket folded in a sheathing body around a pyrotechnic gas generator. When the life buoy or life jacket reaches near the person, the life buoy or life jacket is inflated by means of gas generator gases. The folded life buoy or life jacket is launched from a launching tube provided with a firing handle and a launching gas generator.

20 Claims, 2 Drawing Sheets

INFLATABLE LIFE BUOY LAUNCHER GUN

BACKGROUND OF THE INVENTION

Maritime security regulations stipulate the provision and use of equipment for aiding buoyancy; however, in very many cases, there exists a need for supplementary equipment capable of providing immediate help to a person in the water situated at a distance of some tens of meters, this also being possible in heavy weather and against the wind.

SUMMARY OF THE INVENTION

The inflatable life buoy launcher gun disclosed in this Patent makes it possible, thanks to its innovative design and structure, to meet this need.

The inflatable life buoy launcher gun is a launcher containing a projectile, a propulsive charge for the latter and a firing device therefor.

The projectile is constituted by a lifejacket which is folded around a gas generator, and its initiation system, controlled either by a delaying means which is triggered upon firing, or by an impact detector.

The inflatable life buoy launcher gun makes it possible to project, in the direction of a person in the sea at variable distances, a projectile containing a life jacket fitted with a pyrotechnic device for automatic inflation. The life jacket once inflated, and after having reached its target, in a region close to tile person in the sea, will provide temporary assistance allowing the latter to wait definitive help, with greater security and better comfort. The originality of the design and structure of the inflatable life buoy launcher gun will become more clear from the description of the equipment (FIG. 1) and its operation (FIG. 2) disclosed below this being done by way of illustration which is non-limiting.

DETAILED DESCRIPTION OF THE INVENTION

Figure 1:
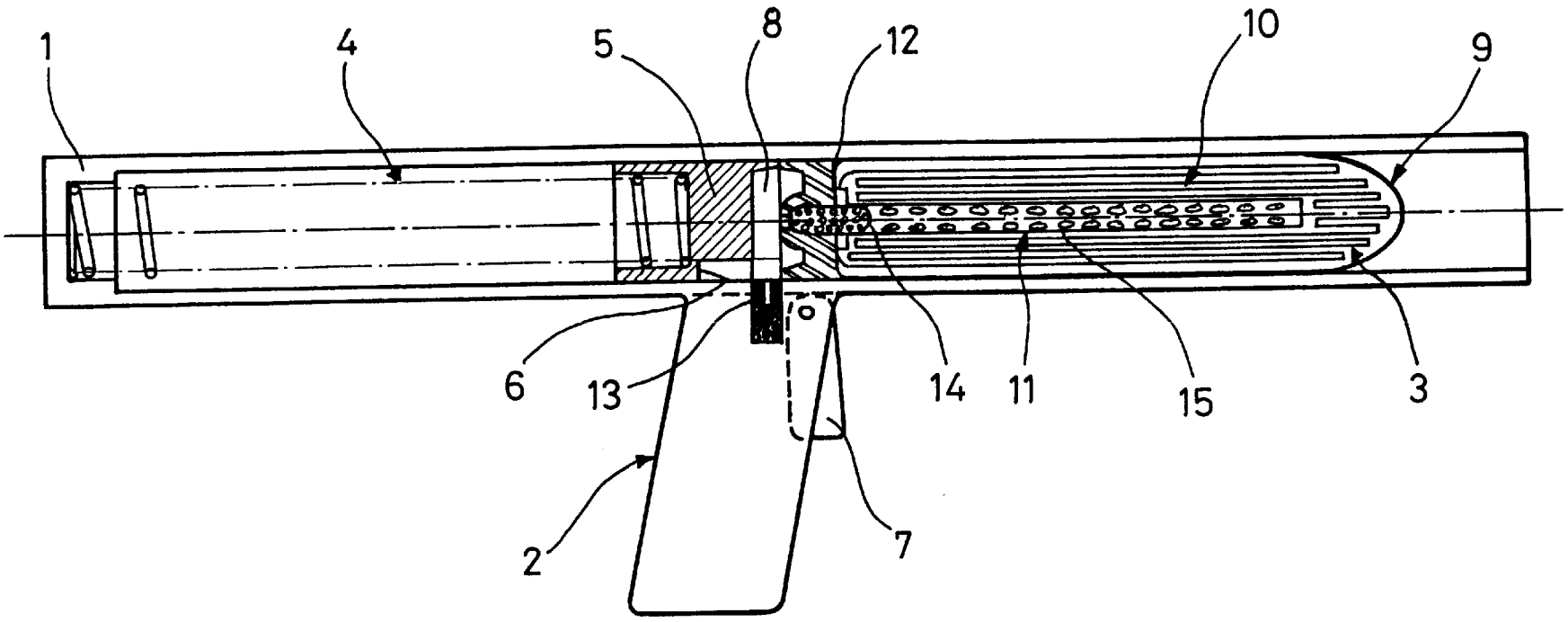
FIG. 1 is a cross-sectional view of the inflatable life buoy launcher gun in accordance with one embodiment of the invention.
Figure 2:
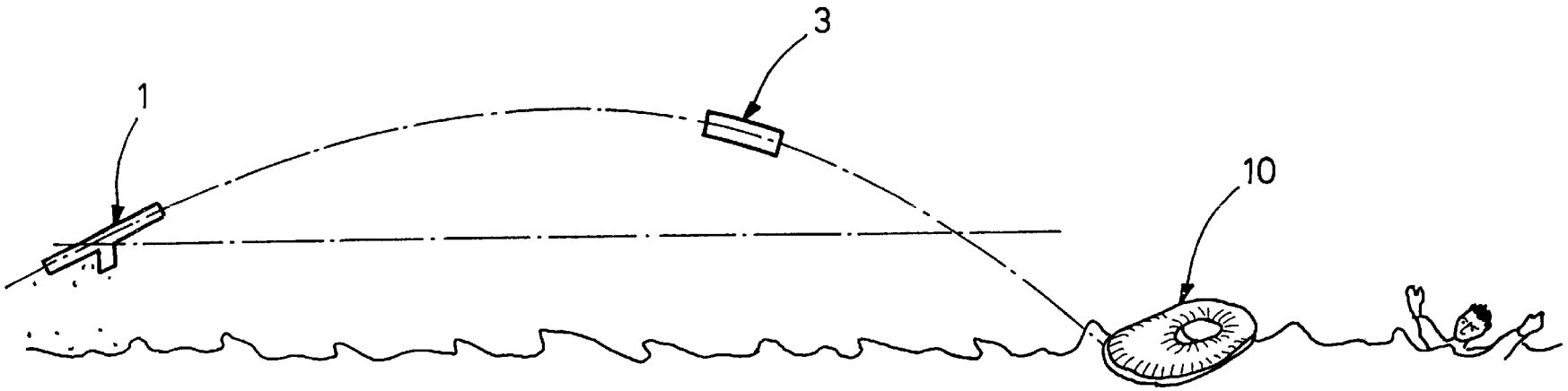
FIG. 2 is a schematic illustration of operation of the inflatable life buoy launcher gun in accordance with one embodiment of the invention.

According to the invention, the inflatable life buoy launcher sun is constituted by a launching tube or barrel 1, fitted with a firing handle 2. Barrel 1, which is preferably made of a composite material (fiber mat or heat-setting resin-glass rovings) is closed at the back. It contains projectile 3, a recoil mass 5, and a recoil damping spring 4.

Without departing from the scope of the invention, the spring can be replaced by an energy absorber in a flexible or composite material.

Recoil mass 5 is pinned inside the barrel, and its return is limited by a stop 6.

Projectile 3 contains an inflatable life jacket 10 or life buoy, preferably folded around a gas distributor 11 containing the pyrotechnic gas generator 15 and its pyrotechnic firing delay means 14 located in the cap or back-end 12 of the projectile. The projectile is closed by its cap or back-end and projectile body 9. Projectile body 9 is preferably a flexible case obtained using a thermoplastic resin film. Without departing from the scope of the invention, this projectile body could be made in another material such as a natural or synthetic elastomer material; or a rigid thermoplastic material with specific areas of weakness.

Launching of projectile 3 is provided for by a launching pyrotechnic gas generator 13 which is preferably located inside the firing handle 2 and which discharges into thrust chamber 8. Without departing from the scope of the invention launching pyrotechnic gas generator 13 can also be located in the back end or cap 12 of the projectile 3.

Ignition of the launching pyrotechnic gas generator is preferably achieved by percussions, performed by the firing handle. Without departing from the scope of the invention, such ignition can be obtained by means of an electric safety igniter which is fired by the energy of a battery or storage battery located in the firing handle.

Without departing from the scope of the invention, the launching tube or barrel 1 can be fitted with sighting or aiming means to facilitate use of the inflatable life buoy launcher gun.

Without departing from the scope of the invention, gas generator 15 for inflating the inflatable watertight flexible structure can be placed against the rear end or cap of the projectile, attached at an extremity of its folded flexible structure.

In the preferred structure with pyrotechnic delaying means, operation of the inflatable life buoy launcher gun is generally as follows:

Firing of launching gas generator 13 by exercising pressure on the movable portion of firing handle 2.

Generation of gases in the launching chamber 8.

Ignition of pyrotechnic delay means 14 via hot gases delivered by the launching gas generator 13.

Acceleration of projectile 3 and of the recoil mass after shearing the positioning pins inside launching tube or barrel 1.

Exist of projectile 3 for flee flight towards the target.

Damping of movement by a recoil mass 5 against spring 4 or an energy absorber.

The projectile reaches its target and a few instants later, 1 to 3 seconds, pyrotechnic delay device 14 triggers gas generator 15 for inflating the life jacket 10.

Under pressure, the body of projectile 9 ruptures and allows life jacket 10 to inflate which then comes to the surface of the water and is available to the person in difficulties.

What is claimed is:

1. An emergency aid device adapted to be handheld, comprising:

a projectile having an inflatable watertight flexible structure and an inflation pyrotechnic gas generator for inflating said flexible structure;

a pyrotechnic launching barrel adapted for receiving said projectile; and a launching pyrotechnic gas generator for projecting said projectile out of said launching barrel.

2. The device according to claim 1, wherein said flexible structure is located inside a flexible case able to tear upon inflation of said flexible structure.

3. The device according to claim 1, wherein a damping of a recoil mass is provided by a spring or by an energy absorber in a flexible or composite material.

4. The device according to claim 1, wherein said launching pyrotechnic gas generator is located inside a firing handle fitted on said launching barrel and discharges into a launching chamber of said launching barrel.

5. The device according to claim 1, wherein said inflation pyrotechnic gas generator contains pyrotechnic ignition delaying means which are initiated using hot gases delivered by said launching pyrotechnic gas generator.

6. The device according to claim 1, wherein said flexible structure is located inside a flexible case able to tear upon inflation of said flexible structure and wherein said launching pyrotechnic gas generator is located inside a firing handle fitted on said launching barrel and discharges into a launching chamber of said launching barrel.

7. An emergency aid device adapted to be handheld, comprising:

a projectile having an inflatable watertight flexible structure and an inflation pyrotechnic gas generator for inflating said flexible structure;

a pyrotechnic launching barrel adapted for receiving said projectile; and a launching pyrotechnic gas generator for projecting said projectile out of said launching barrel; and wherein said inflatable watertight flexible structure is folded around a distributor containing said inflation pyrotechnic gas generator.

8. The device according to claim 7, wherein said flexible structure is located inside a flexible case able to tear upon inflation of said flexible structure.

9. The device according to claim 7, herein a damping of a recoil mass is provided by a spring or by an energy absorber in a flexible or composite material.

10. The device according to claim 7, wherein said launching pyrotechnic gas generator is located inside a firing handle fitted on said launching barrel and discharges into a launching chamber of said launching barrel.

11. The device according to claim 7, wherein said inflation pyrotechnic gas generator contains pyrotechnic ignition delaying means which are initiated using hot gases delivered by said launching pyrotechnic gas generator.

12. The device according to claim 7, wherein:

said flexible structure is located inside a flexible case able to tear upon inflation of said flexible structure; and said launching pyrotechnic gas generator is located inside a firing handle of said launching barrel and discharges into a launching chamber of said launching barrel.

13. The device according to claim 7, wherein:

said flexible structure is located inside a flexible case able to tear upon inflation of said flexible structure;

said launching pyrotechnic gas generator is located inside a firing handle fitted on said launching barrel and discharges into a launching chamber of said launching barrel; and said inflation pyrotechnic gas generator contains pyrotechnic ignition delaying means which are initiated using hot gases delivered by said launching pyrotechnic gas generator.

14. An emergency aid device adapted to be handheld, comprising:

a projectile having an inflatable watertight flexible structure and an inflation pyrotechnic gas generator for inflating said flexible structure;

a pyrotechnic launching barrel adapted for receiving said projectile; and a launching pyrotechnic gas generator for projecting said projectile out of said launching barrel; and wherein said projectile comprises a back-end or cap, said inflation pyrotechnic gas generator being located between said back-end or cap and said, flexible structure.

15. The device according to claim 14, wherein said flexible structure is located inside a flexible case able to tear upon inflation of said flexible structure.

16. The device according to claim 14, wherein a damping of a recoil mass is provided by a spring or by an energy absorber in a flexible or composite material.

17. The device according to claim 14, wherein said launching pyrotechnic gas generator is located inside a firing handle fitted on said launching barrel and discharges into a launching chamber of said launching barrel.

18. The device according to claim 14, wherein said inflation pyrotechnic gas generator contains pyrotechnic ignition delaying means which are initiated using hot gases delivered by said launching pyrotechnic gas generator.

19. The device according to claim 14, wherein:

said flexible structure is located inside a flexible case able to tear upon inflation of said flexible structure; and said launching pyrotechnic gas generator is located inside a firing handle fitted on said launching barrel and discharges into a launching chamber of said launching barrel.

20. The device according to claim 14, wherein:

said flexible structure is located inside a flexible case able to tear upon inflation of said flexible structure;

said launching gas generator is located inside a firing handle fitted on said launching barrel and discharges into a launching chamber of said launching barrel; and said inflation pyrotechnic gas generator contains pyrotechnic ignition delaying means which are initiated using hot gases delivered by said launching gas generator.

* * * * *